US008295440B2

(12) United States Patent
Cho et al.

(10) Patent No.: US 8,295,440 B2
(45) Date of Patent: Oct. 23, 2012

(54) SUPER MINIATURE X-RAY TUBE USING NANO MATERIAL FIELD EMITTER

(75) Inventors: Sung Oh Cho, Daejeon (KR); Sung Hwan Heo, Daejeon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 211 days.

(21) Appl. No.: 12/898,274

(22) Filed: Oct. 5, 2010

(65) Prior Publication Data

US 2011/0188635 A1 Aug. 4, 2011

(30) Foreign Application Priority Data

Feb. 3, 2010 (KR) ..... 10-2010-0010084

(51) Int. Cl.
*H01J 35/06* (2006.01)

(52) U.S. Cl. ..... 378/122; 378/138; 378/143

(58) Field of Classification Search ..... 378/122, 378/121, 119, 136, 138, 140, 143
See application file for complete search history.

(56) References Cited

U.S. PATENT DOCUMENTS

| | | | | |
|---|---|---|---|---|
| RE34,421 | E | 10/1993 | Parker et al. | |
| 5,428,658 | A | 6/1995 | Oettinger et al. | |
| 5,442,678 | A | 8/1995 | Dinsmore et al. | |
| 6,324,257 | B1 * | 11/2001 | Halavee | 378/121 |
| 6,353,658 | B1 * | 3/2002 | Trebes et al. | 378/123 |
| 6,438,206 | B1 * | 8/2002 | Shinar et al. | 378/123 |
| 6,914,960 | B2 * | 7/2005 | Swanson et al. | 378/119 |
| 7,086,577 | B2 | 8/2006 | Chornenky et al. | |
| 7,130,380 | B2 | 10/2006 | Lovoi et al. | |

(Continued)

FOREIGN PATENT DOCUMENTS

KR 1020080054818 12/2009

OTHER PUBLICATIONS

M. Dinsmore, et al, A New Miniature X-Ray Source for Interstitial Radiosurgery: Device description, Jan. 1996, Am. Assoc. Phys. Med., vol. 23 No. 1, pp. 45-52.

(Continued)

*Primary Examiner* — Hoon Song
(74) *Attorney, Agent, or Firm* — Moss & Barnett

(57) ABSTRACT

A super miniature X-ray tube using the nano material field emitter includes a tip-tip-type cathode electrode having the nano material field emitter formed on one end with a planar section thereof to generate an electron beam, a gate electrode formed in a hollow cylindrical shape and surrounding an outer circumference of the cathode electrode, the gate electrode having a tapered portion formed on one end and inclined from inside to outside, the gate electrode receiving a voltage for generating the electron beam, a high voltage insulating portion formed in a hollow cylindrical shape and surrounding an outer circumference of the gate electrode, a anode electrode formed at a predetermined distance from one end of the high voltage insulating portion and receiving an acceleration voltage to accelerate an electron beam generated at the cathode electrode, and an electric field adjusting electrode formed between the high voltage insulating portion and the anode electrode to vary a pattern of an acceleration electric field, wherein the cathode electrode includes an open portion formed on one side to receive therein the electric field adjusting electrode, and an X-ray generating portion formed on the other side to generate an X-ray by a collision of an accelerated electron beam.

22 Claims, 9 Drawing Sheets

U.S. PATENT DOCUMENTS

| | | | | |
|---|---|---|---|---|
| 7,130,381 | B2 | 10/2006 | Lovoi et al. | |
| 7,158,612 | B2 | 1/2007 | Rusch et al. | |
| 7,317,278 | B2 | 1/2008 | Busta | |
| 7,338,487 | B2 * | 3/2008 | Chornenky et al. | 606/33 |
| 7,382,857 | B2 | 6/2008 | Engel | |
| 7,382,862 | B2 | 6/2008 | Bard et al. | |
| 7,428,298 | B2 | 9/2008 | Bard et al. | |
| 2003/0021377 | A1 * | 1/2003 | Turner et al. | 378/102 |
| 2009/0060142 | A1 | 3/2009 | Adams | |

OTHER PUBLICATIONS

Mark J. Rivard, et al., Calculated and Measured Brachytherapy Dosimetry Parameters in Water for the Xoft Axxent X-Ray Source: An Electronic Brachtherapy Source, Nov. 2006, Am. Assoc. Phys. Med. vol. 33 No. 11, pp. 4020-4032.

Sung Hwan Heo, et al., Stable Field Emitters for a Miniature X-Ray Tube Using Carbon Nanotube Drop Drying on a Flat Metal Tip, Nanoscale Res Lett, Jan. 23, 2010, 5:720-724.

* cited by examiner

SUPER MINIATURE X-RAY TUBE USING NANO MATERIAL FIELD EMITTER

CROSS-REFERENCES TO RELATED APPLICATION

This patent application claims the benefit of priority under 35 U.S.C. §119 from Korean Patent Application No. 10-2010-0010084 filed on Feb. 3, 2010, the contents of which are incorporated herein by reference.

BACKGROUND OF THE INVENTION

1. Field of the Invention

Tubes consistent with what is disclosed herein relate to a super miniature X-ray tube using a nano material field emitter.

2. Description of the Related Art

The cancer management options include, mainly, surgery (physical option) and chemotherapy (biological option).

The surgery generally removes tumor from a target area completely, but may involve intrusion on a patient's body such as considerable physical wound and damages to the functional organs. Besides, this mechanical process may have remaining cancer cell after the surgery.

The chemotherapy injects a substance fatally reactant exclusively to the cancer cells to kill the cancer cells, but generally, this treatment results in painful side effects and does not guarantee complete cure from the cancer, although this may delay the growth and spread of the cancer by a certain period of time.

Radiation therapy mainly induces killing of cancerous cells having faster cycles of cell division than normal cells, by focusing radioactive energy to a target are of the body.

According to the previous clinical tests, radiation therapy has been particularly effective in attacking the body area to where access by surgery is not allowed, showing noticeable treatment. At the same time, due to minimized intrusion on the human body and no damages to the organs, this treatment can keep body functions intact.

The radiation therapy may be generally categorized into two therapies: i) radiotherapy (or teletherapy) in which a relatively large sized accelerator or radioactive isotope irradiates radioactive ray into a patient's body; and ii) brachytherapy in which a radiation source is installed near the cancer cell to locally treat the cancer.

Since the external radiotherapy irradiates radioactive ray also to the healthy tissues around the cancer cells, this type of therapy involves damage to the healthy tissues. However, the brachytherapy can minimize the damage to the normal cells. The brachytherapy also has a relatively high dose rate and thus takes a relatively short time for treatment.

Generally, the brachytherapy utilizes radioactive isotope as the source of radiation.

Although the radioactive isotopes are advantageous particularly in terms of compactness, it has some disadvantages, which are: i) continuous generation of radioactive rays keeps a person handling the radioactive isotope at a risky exposure to the radioactive rays; ii) the short half life period requires supply of radioactive source on a regular basis, and strict requirements for storage, maintenance and disposal of the radioactive wastes.

In order to overcome the abovementioned disadvantages, a miniature X-ray tube, which is small enough to be inserted in the human body, has been developed.

The X-ray tube generates X-ray only in response to an input of electric current, and accordingly, neither a doctor nor a patient is exposed to the radioactive rays unnecessarily. Additionally, because it is possible to adjust the generated radioactive energy and the rem dose distribution easily, the effective cancer treatment based on appropriately-regulated rem dose distribution is provided, and because the radioactive rays are generated only in response to the electric current, strict requirements for production, storage, maintenance, or disposal of waste, are not necessary.

The currently-available X-ray tube generally employs a metal such as tungsten provided in a filament shape, and therefore, implements a thermionic emission method which forms thermal electrons generated by the heating at high temperature, into beam patterns.

However, in the application of the source of thermal electron beams for use in the miniature X-ray tube, the heat can damage the healthy cells, and the source can not be compact-sized because a small-size source may have the limited density of electric current of the electron beams.

Meanwhile, the recent development in the nano technology has motivated many to study the X-ray tubes utilizing nano material field emitter.

The nano material field emitter, which gives off electron beams in an electroluminescent manner, does not generate heat, requires only a simple powering device, and generates electron beams with the density of electric current a hundred times as large as that of the thermionic emission and thus can generate high power X-ray. Additionally, the cathode can be compact-sized, and it is also easy to adjust the time structure of generating X-rays.

Most currently-available equipments for brachytherapy employ thermionic emission. If a new technology based on the nano material field emitter is utilized, a new type of brachytherapy device, which is compacter and which generates X-rays with higher rem rate compared to the existing devices, could be developed.

SUMMARY OF THE INVENTION

Exemplary embodiments overcome the above disadvantages and other disadvantages not described above. Also, the embodiments are not required to overcome the disadvantages described above, and an exemplary embodiment of the present invention may not overcome any of the problems described above.

In one embodiment, a super miniature X-ray tube using a nano material field emitter is provided. The super miniature X-ray tube using the nano material field emitter implements a tip-type nano material cathode electrode to thus resolve problems of the excessive consumption of electricity for heating a filament cathode electrode and the unnecessarily large size of an external cooling system, and to reduce the size of the X-ray tube and improve output and thus increase availability as a radioactive source of the brachytherapy implanted in a human body.

In one embodiment, a super miniature X-ray tube using a nano material field emitter may include a tip-type cathode electrode comprising the nano material field emitter formed on one end with a planar section thereof to generate an electron beam, a gate electrode formed in a hollow cylindrical shape and surrounding an outer circumference of the cathode electrode, the gate electrode comprising a tapered portion formed on one end and inclined from inside to outside, the gate electrode receiving a voltage for generating the electron beam, a high voltage insulating portion formed in a hollow cylindrical shape and surrounding an outer circumference of the gate electrode, a anode electrode formed at a predetermined distance from one end of the high voltage insulating portion and receiving an acceleration voltage to accelerate an electron beam generated at the cathode electrode, and an electric field adjusting electrode formed between the high voltage insulating portion and the anode electrode to vary a pattern of an acceleration electric field, wherein the cathode electrode comprises an open portion formed on one side to receive therein the electric field adjusting electrode, and an X-ray generating portion formed on the other side to generate an X-ray by a collision of an accelerated electron beam.

The super miniature X-ray tube may additionally include a getter target formed on an inner side of the open portion of the anode electrode to maintain an interior of the X-ray tube in a vacuum state.

The X-ray generating portion may include an X-ray target which generates an X-ray by a collision of an accelerated electron beam, and an X-ray permeable window which covers an outer surface of the X-ray target, the X-ray permeable window on which the X-ray target is deposited and which emits the X-ray to outside.

The X-ray target may be formed from at least one of: molybdenum (Mo), tantalum (Ta), tungsten (W), copper (Cu), and gold (Au).

The X-ray permeable window may be formed from at least one of: beryllium (Be), beryllium-copper (BeCu), Beryllium-Aluminum (BeAl), aluminum (Al), carbon (C), and copper (Cu).

The electric field adjusting electrode may either converge or diverge the electron beam.

The electric field adjusting electrode may include a rear inclining protrusion formed on an inner circumference and inclining towards the cathode electrode, or a first inclining protrusion formed on an inner circumference and inclining towards the anode electrode.

The front or rear inclining protrusion may be formed at an angle approximately between 0 and 40 degrees with respect to an inner circumference of the electric field adjusting electrode.

The tapered portion may be at an angle approximately between 5 and 30 degrees with respect to an inner circumference of the gate electrode.

The gate electrode may include a first stepped portion formed on an inner circumference to which the cathode electrode is fixed; and a second stepped portion formed on an outer circumference to which the open portion formed on one side of the high voltage insulating portion is fixed.

The gate electrode may include a first stepped portion formed on an inner circumference to which the first high voltage insulating portion is fixed; and a second stepped portion formed on an outer circumference to which the open portion formed on one side of the second high voltage insulating portion is fixed.

In another embodiment, a super miniature X-ray tube using a nano material field emitter may include a tip-type cathode electrode comprising the nano material field emitter formed on one end with a planar section thereof to generate an electron beam, a first high voltage insulating portion formed in a hollow cylindrical shape and surrounding an outer circumference of the cathode electrode, a gate electrode formed in a hollow cylindrical shape and surrounding an outer circumference of the first high voltage insulating portion, the gate electrode comprising a tapered portion formed on one end and inclining from inside to outside, the gate electrode receiving a voltage for generating the electron beam, a second high voltage insulating portion formed in a hollow cylindrical shape and surrounding an outer circumference of the gate electrode, a anode electrode formed at a predetermined distance from one end of the second high voltage insulating portion and receiving an acceleration voltage for accelerating an electron beam generated at the cathode electrode, and an electric field adjusting electrode formed between the second high voltage insulating portion and the anode electrode to adjust a size of the electron beam by varying a pattern of the accelerated electric field, wherein the anode electrode comprises an open portion formed on one side to receive therein the electric field adjusting electrode, and an X-ray generating portion formed on the other side to generate an X-ray by a collision of the accelerated electron beam.

The X-ray generating portion may include an X-ray target which generates an X-ray by a collision of an accelerated electron beam, and an X-ray permeable window which covers an outer surface of the X-ray target, the X-ray permeable window on which the X-ray target is deposited and which emits the X-ray to outside. The X-ray target may be formed from at least one of: molybdenum (Mo), tantalum (Ta), tungsten (W), copper (Cu), and gold (Au). The X-ray permeable window may be formed from at least one of: beryllium (Be), beryllium-copper (BeCu), Beryllium-Aluminum (BeAl), aluminum (Al), carbon (C), and copper (Cu).

The electric field adjusting electrode may either converge or diverge the electron beam. The electric field adjusting electrode may include a rear inclining protrusion formed on an inner circumference and inclining towards the cathode electrode, or a first inclining protrusion formed on an inner circumference and inclining towards the anode electrode. The front or rear inclining protrusion may be formed at an angle approximately between 0 and 40 degrees with respect to an inner circumference of the electric field adjusting electrode.

The tapered portion may be at an angle approximately between 5 and 30 degrees with respect to an inner circumference of the gate electrode. The gate electrode may include a first stepped portion formed on an inner circumference to which the cathode electrode is fixed; and a second stepped portion formed on an outer circumference to which the open portion formed on one side of the high voltage insulating portion is fixed.

The gate electrode may include a first stepped portion formed on an inner circumference to which the first high voltage insulating portion is fixed; and a second stepped portion formed on an outer circumference to which the open portion formed on one side of the second high voltage insulating portion is fixed. The first high voltage insulating portion, and the second high voltage insulating portion are each formed from one of: alumina ($Al_2O_3$), sapphire, Teflon®, Pyrex®, and glass.

BRIEF DESCRIPTION OF THE DRAWINGS

The above and/or other aspects of what is described herein will be more apparent by describing certain exemplary embodiments with reference to the accompanying drawings, in which.

DETAILED DESCRIPTION OF THE INVENTION

Figure 1:
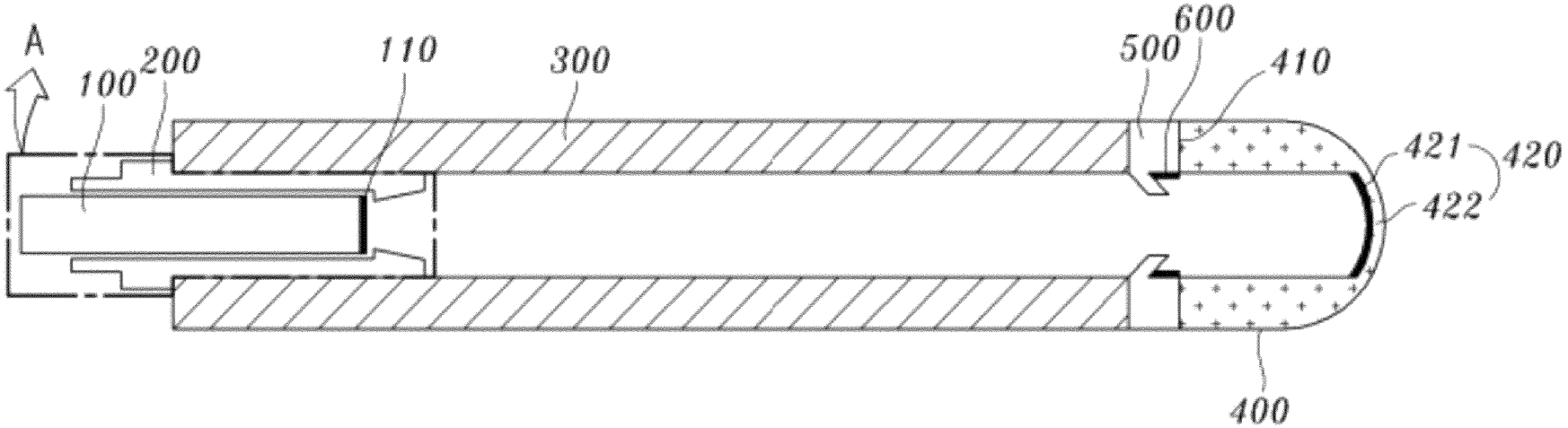
FIG. 1 is a cross section view of a super miniature X-ray tube using a nano material field emitter according to an embodiment.

Certain exemplary embodiments will now be described in greater detail with reference to the accompanying drawings.

In the following description, same drawing reference numerals are used for the same elements even in different drawings. The matters defined in the description, such as detailed construction and elements, are provided to assist in a comprehensive understanding of the present inventive concept. Accordingly, it is apparent that the exemplary embodiments of the present inventive concept can be carried out without those specifically defined matters. Also, well-known functions or constructions are not described in detail since they would obscure the invention with unnecessary detail.

Figure 2:
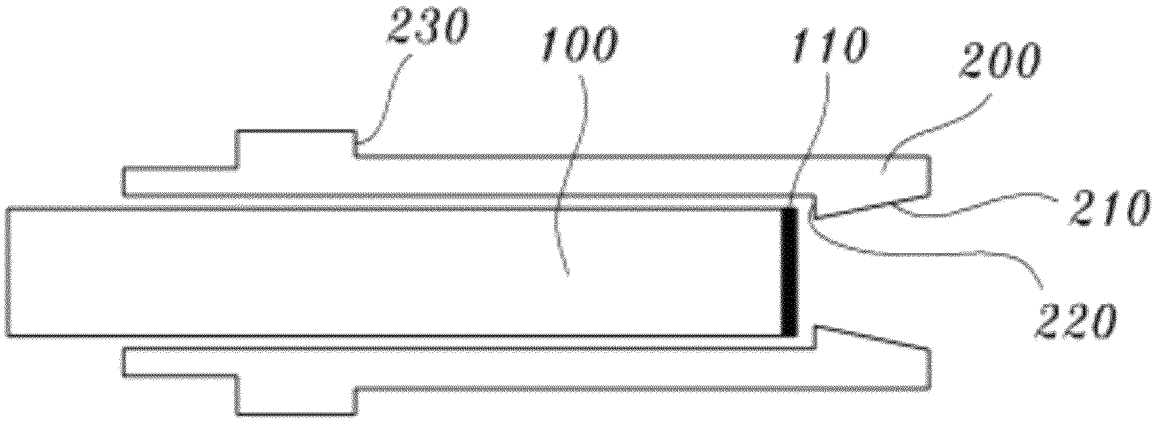
FIG. 2 illustrates the portion A of FIG. 1 in enlargement.

FIG. 1 is a cross section view of a super miniature X-ray tube using a nano material field emitter according to an embodiment, and FIG. 2 illustrates the portion A of FIG. 1 in enlargement.

Referring to FIGS. 1 and 2, a super miniature X-ray tube using a nano material field emitter according to a first embodiment may include a tip-type cathode electrode 100, a gate electrode 200, a high voltage insulating portion 300, an anode electrode 400, and an electric field adjusting electrode 500.

The tip-type cathode electrode 100 may be formed from a metal wire, and include a planar surface formed on one end thereof. Accordingly, a nano material field emitter 110 may be formed on the planar surface to generate electron beams.

Figure 5:
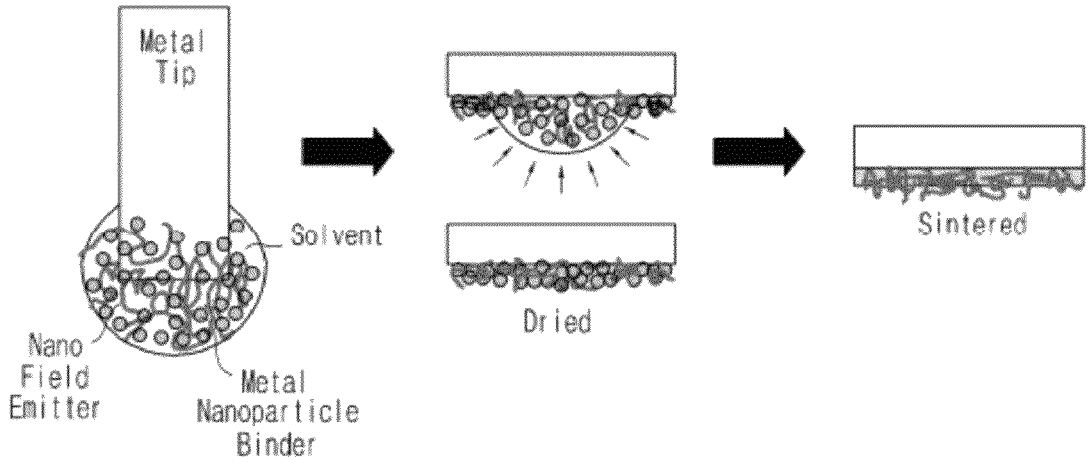
FIG. 5 is a view provided to explain a method of fabricating a tip-type cathode electrode according to an embodiment.

FIG. 5 is a view provided to explain a method of fabricating a tip-type cathode electrode according to an embodiment.

The nano material field emitter 110 may be adhered to one end of the tip-type cathode electrode 100 in a drop coating manner.

Specifically, as illustrated in FIG. 5, a nano material field emitter cathode electrode may be formed on the planar surface of the metal wire, by drying a small amount of droplets of solvent at a suspended state, and then heating the droplets. Herein, the solvent contains a nano field emitter and a metal nanoparticle binder resolved therein.

The metal binding layer, formed by fusing the metal nanoparticle binder, fixes the nano field emitter firmly, and has the high degree of thermal conductivity and lower degree of electric resistance, so is able to form a stable nano particle field emitter layer which has a longer life span and which generates high power electron beams under low vacuum condition.

Figure 6:
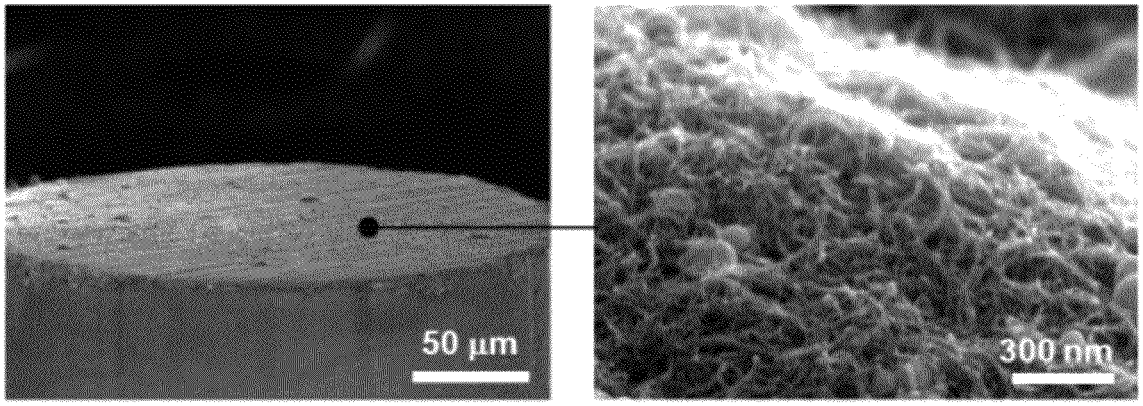
FIG. 6 shows the scanning electron microscope (SEM) images of a tip-type cathode electrode and the end of the tip-type cathode electrode according to an embodiment, respectively.

FIG. 6 shows the scanning electron microscope (SEM) images of a tip-type cathode electrode and the end of the tip-type cathode electrode according to an embodiment, respectively.

Referring to FIG. 6, the tip-type cathode electrode 100 may include a metal tip formed in a wire configuration, and a nano material field emitter formed densely on an end of the metal tip.

The tip-type cathode electrode 100 may be fabricated by treating one end (0.1 to 1 mm in diameter) of the metal wire into a planar section by mechanical grinding or chemical etching, and forming the nano field emitter on the planar section of the metal wire.

The metal material may include tungsten (W), nickel (Ni), titanium (Ti), silver (Ag), or copper (Cu), and the nano field emitter may be formed on the metal wire by dielectrophoresis, laser vaporization, chemical vapor deposition (CVD), printing, or drop coating illustrated in FIG. 5.

The gate electrode 200 receives an electron beam generating voltage, and as illustrated in FIGS. 1 and 2, may be formed in a hollow cylindrical shape which surrounds the outer circumference of the cathode electrode 100 and includes, formed on one end, a tapered portion 210 inclining from inside to outside.

The tapered portion 210 may incline at an angle from about 5 to about 30 degrees, with respect to the inner circumference of the gate electrode 200.

The gate electrode 200 may be formed on the tip-type cathode electrode 100 to reduce electric field, thereby preventing the tip-type cathode electrode 100 and the anode electrode 400 from being increasingly distanced away from each other due to a low degree of electron generating electric field of the nano field emitter 110 in a diode type of X-ray tube which includes the tip-type cathode electrode 100 and the anode electrode 400.

Referring to FIG. 2, the gate electrode 200 may include a first stepped portion 220 formed on the inner circumference in the form of a cylindrical hole, and a second stepped portion 230 formed on the outer circumference also in the form of a cylindrical hole.

Herein, the first stepped portion 220 may firmly receive therein the tip-type cathode electrode 100, and the second stepped portion 230 may firmly receive therein an open end of the high voltage insulating portion 300.

The high voltage insulating portion 300 may be formed in a hollow cylindrical configuration, and surround the outer circumference of the gate electrode 200.

As explained above, the high voltage insulating portion 300 may keep the cathode electrode 100 and the anode electrode 400 at a distance from each other and thus insulate the cathode and anode electrodes 100, 400 from each other, because the open end is firmly inserted in the second stepped portion 230 of the gate electrode 200. The high voltage insulating portion 300 may be formed from one of alumina ($Al_2O_3$), sapphire, Teflon®, Pyrex®, and glass.

The anode electrode 400 may be at a predetermined distance from one end of the high voltage insulating portion 300, and receive the acceleration voltage to accelerate the electron beams generated from the cathode electrode 100.

Referring back to FIG. 1, the anode electrode 400 may include an open portion 410 formed on one side and an X-ray generating portion 420 formed on the other side, in which the electric field adjusting electrode 500 is formed in the open portion 410. The X-ray generating portion 420 generates an X-ray due to collision of the accelerated electron beams.

The X-ray generating portion 420 may include an X-ray target 421, and an X-ray permeating window 422 which covers the outer side of the X-ray target 421.

The X-ray target 421 may generate an X-ray by the collision of the accelerated electron beams, and may be formed from at least one of: molybdenum (Mo), tantalum (Ta), tungsten (W), copper (Cu), and silver (Au).

Specifically, the X-ray target 421 may include a permeable X-ray target and a reflective X-ray target, in which the permeable X-ray target may include a tungsten (W) membrane deposited thereon, and the reflective X-ray target may include a tungsten (W) mass formed thereon.

The X-ray permeable window 422 may cover the outer surface of the X-ray target 421, and be formed in a relation such that the X-ray target 421 is deposited on the X-ray permeable window 422. The X-ray may be passed through the X-ray target 421 and exit to outside.

The X-ray permeable window 422 may be formed from a firm solid material which permits the X-ray generated at the X-ray target 421 to pass therethrough without a low, and which has a low atomic mass number.

Specifically, the X-ray permeable window 422 may be formed from at least one of beryllium (Be), beryllium-copper (BeCu), Beryllium-Aluminum (BeAl), aluminum (Al), carbon (C), and copper (Cu).

Referring to FIG. 1, the electric field adjusting electrode 500 may be formed in a hollow cylindrical shape, and positioned between the high voltage insulating portion 300 and the anode electrode 400 to adjust the size of the electron beams by varying the pattern of the acceleration electric field.

Figure 7A:
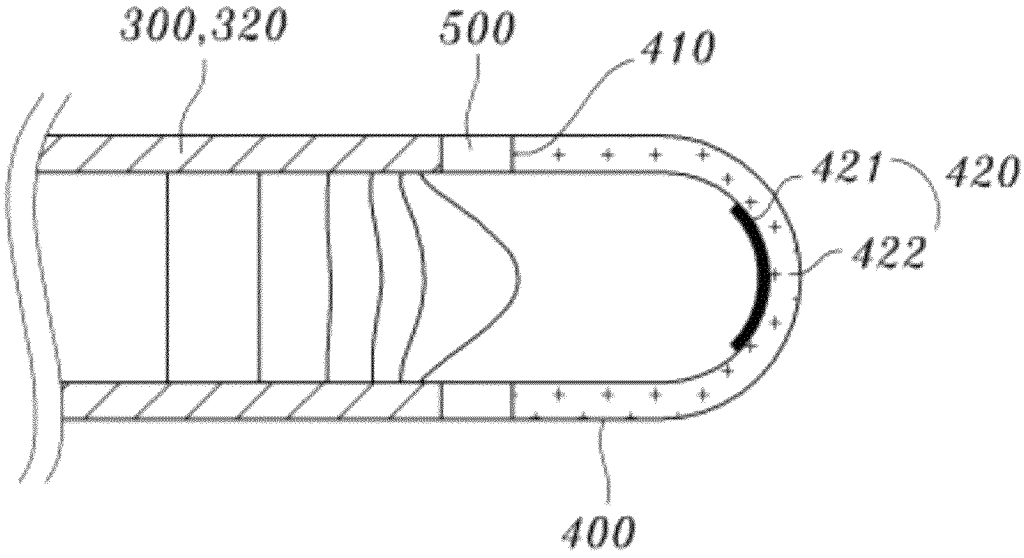
FIGS. 7A to 7C illustrate the formation of electric field inside the X-ray tube using an X-ray generator of a super miniature X-ray tube using a nano material field emitter according to the first and the second embodiments.
Figure 7B:
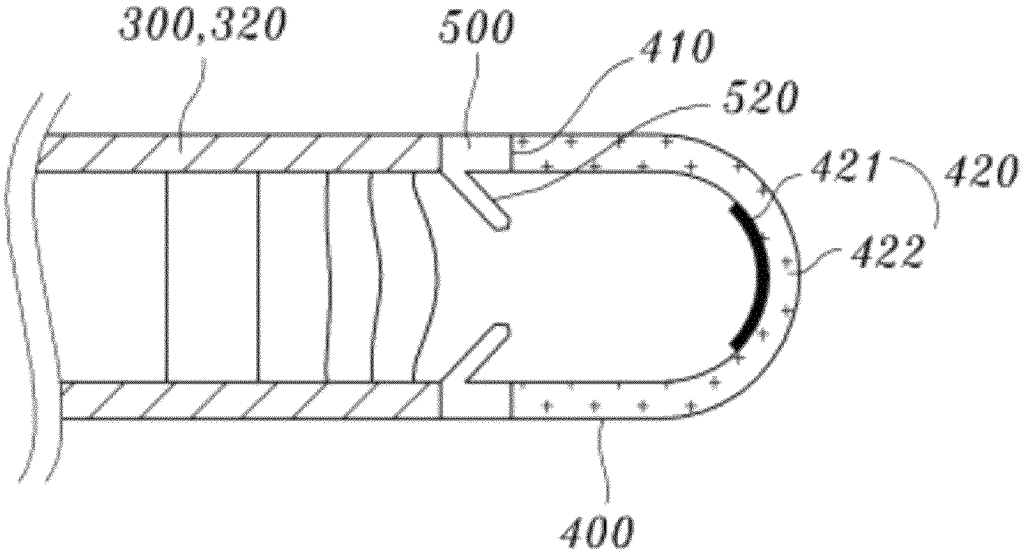
Figure 7C:
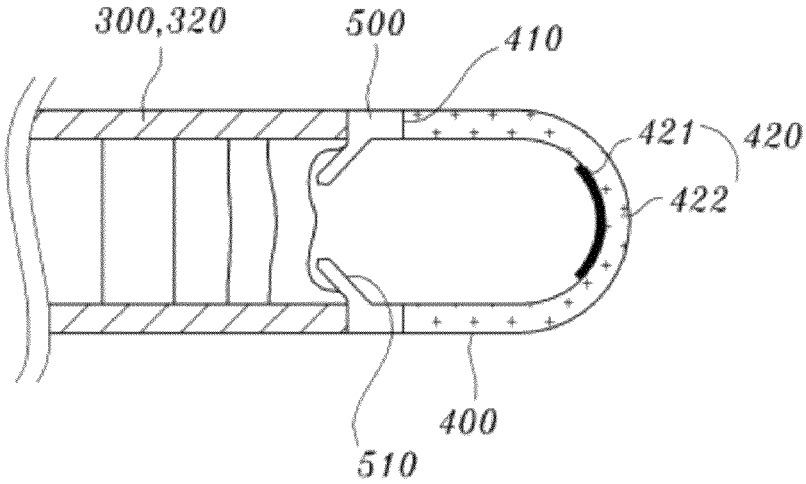

FIGS. 7A to 7C illustrate the formation of electric field inside the X-ray tube using an X-ray generator of a super miniature X-ray tube using a nano material field emitter according to the first and the second embodiments.

Referring to FIGS. 7A to 7C, the electric field adjusting electrode 500 may include a rear inclining protrusion 520 formed on the inner circumference and extended toward the anode electrode 400, and a front inclining protrusion 510 extended toward the cathode electrode 100, to converge or diverge the electron beams.

Specifically, referring to FIG. 7A, the divergent electric field is formed inside the anode electrode 400 by the electric field adjusting electrode 500 having a plane inner surface, so that if a parallel electron beam passes the divergent electric field, the electron beam is accelerated in a direction from the center to outside to collide against the large area of the X-ray target 421.

Additionally, referring to FIG. 7B, due to the electric field adjusting electrode 500 having the rear inclining protrusion 520 extending toward the anode electrode 400 on the inner circumference, a divergent electric field in a size lower than that of FIG. 7A is formed on the inner surface of the anode electrode 400, so that when the parallel electron beam passes the weaker divergent electric field, the electron beam is accelerated less than the parallel electron beam of FIG. 7A in a direction from the center to outside to collide against the X-ray target 421.

Referring to FIG. 7C, due to the electric field adjusting electrode 500 having the front inclining protrusion 510 extending toward the cathode electrode 100 on the inner circumference, almost parallel electric field is formed on the inner surface of the anode electrode 400, so that a parallel electron beam passes through the parallel electric field without having a considerable change and collides against the X-ray target 421.

Figure 9A:
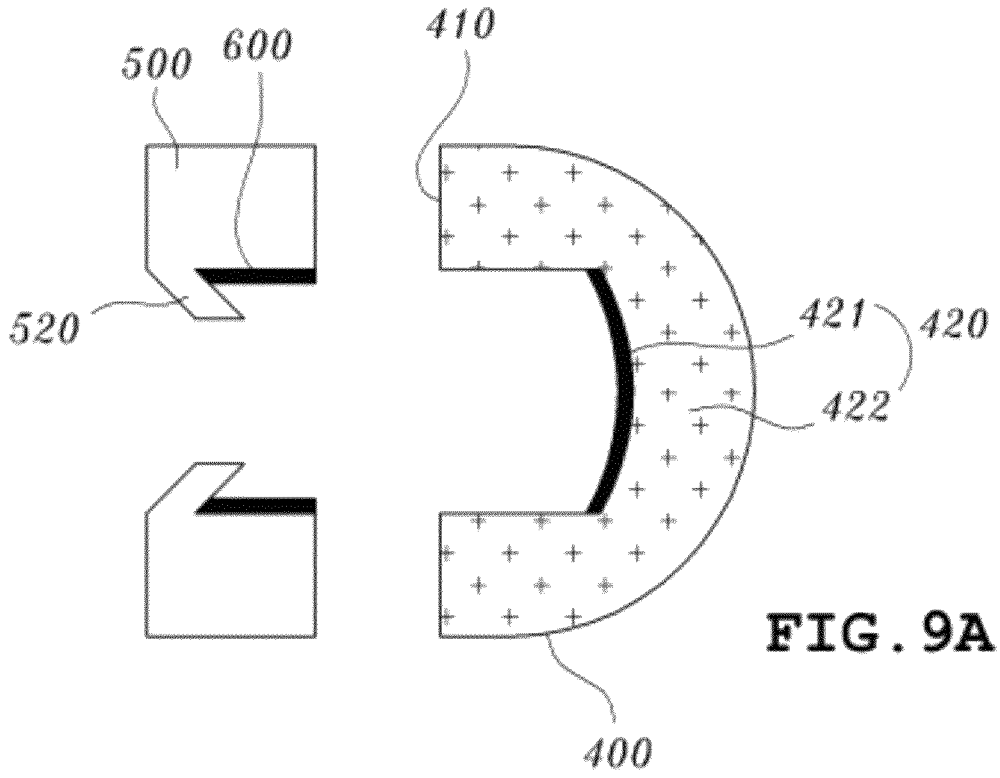
FIGS. 9A to 9C are cross section views of an X-ray generator and an electric field adjusting electrode of a super miniature X-ray tube using a nano material field emitter according to the first and second embodiments.
Figure 9B:
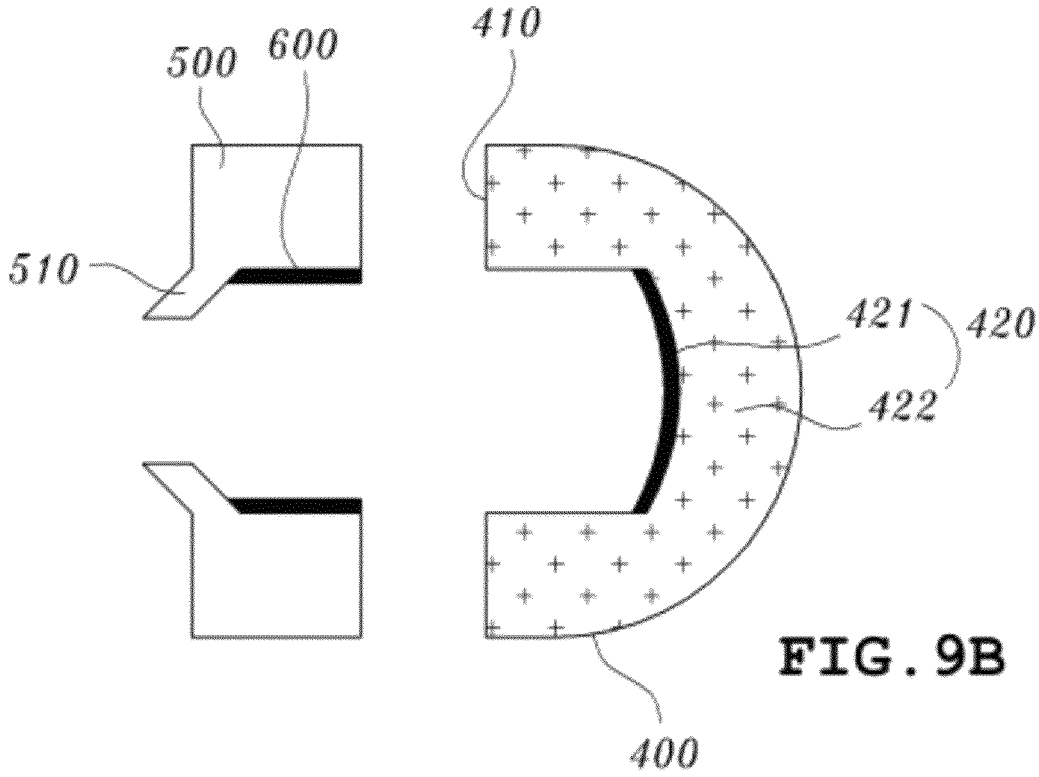
Figure 9C:
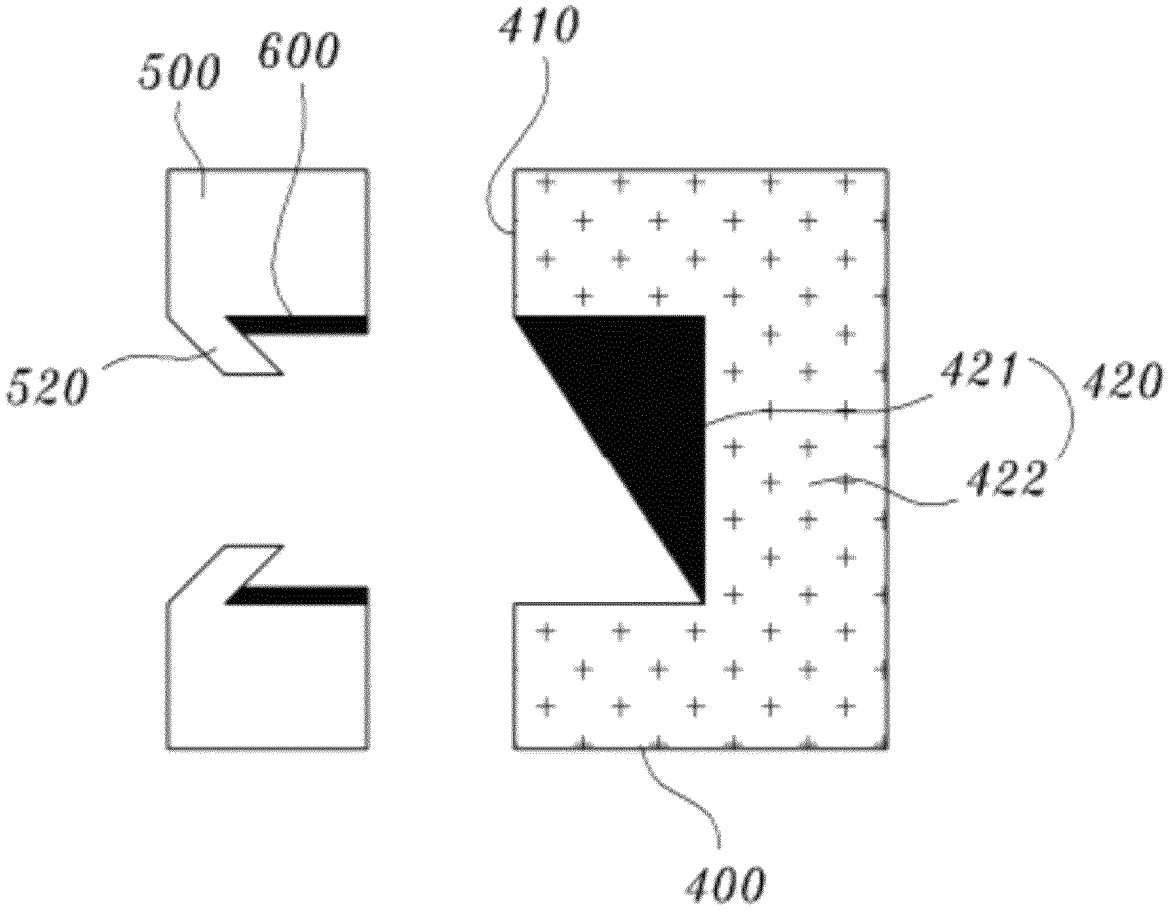

FIGS. 9A to 9C are cross section views of an X-ray generator and an electric field adjusting electrode of a super miniature X-ray tube using a nano material field emitter according to the first and second embodiments.

Referring to FIGS. 9A to 9C, the electric field adjusting electrode 500 may be connected to the open portion 410 of the anode electrode 400, and include the front inclining protrusion 510 and the rear inclining protrusion 520 at inclination from about 0 to about 40 degrees with respect to the inner circumference of the electric field adjusting electrode 500, according to the convergence size of the electron beams.

Meanwhile, according to the first embodiment, the super miniature X-ray tube using a nano material field emitter may additionally include a getter target 600 as illustrated in FIG. 1 and FIGS. 9A to 9C.

The getter target 600 may be formed on the inner side of the open portion 410 of the anode electrode 400, or on the inner surface of the electric field adjusting electrode 500, to maintain the interior of the X-ray tube under vacuum condition.

The getter target 600 may be formed from a gasifiable or non-gasifiable metal alloy and absorb remaining atmospheric gas in vacuum. By way of example, the getter target 600 may be made from barium (Ba), aluminum (Al), magnesium (Mg), zirconium (Zr), vanadium (V), cobalt (Co), titanium (Ti), palladium (Pd), or an alloy thereof.

The super miniature X-ray tube using nano material field emitter according to a second embodiment will be explained in greater detail below.

Figure 3:
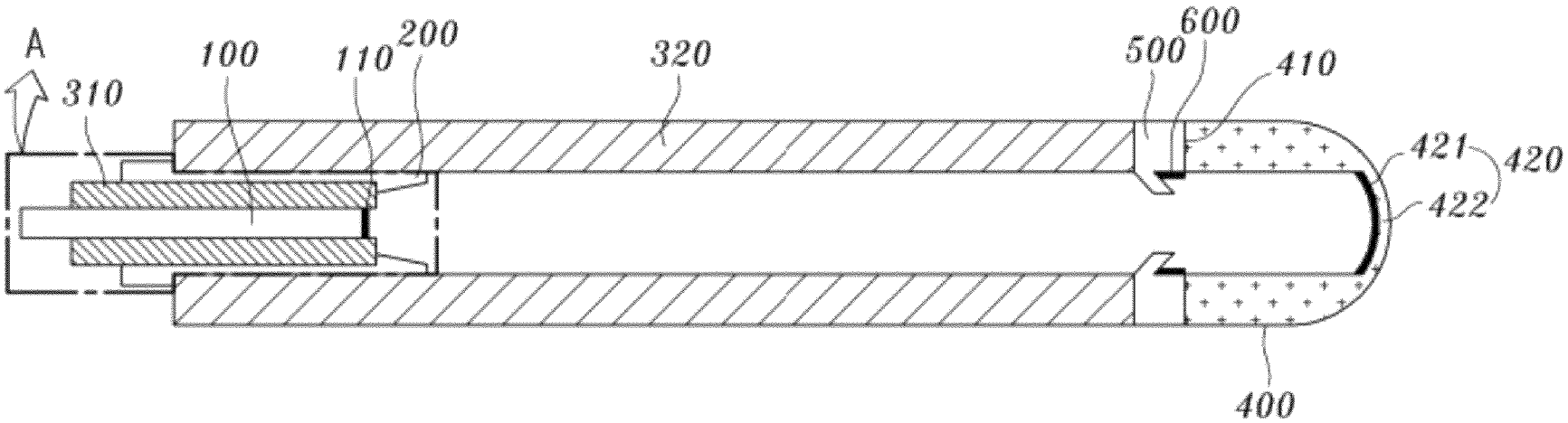
FIG. 3 is cross section view of a super miniature X-ray tube using a nano material field emitter according to a second embodiment.
Figure 4:
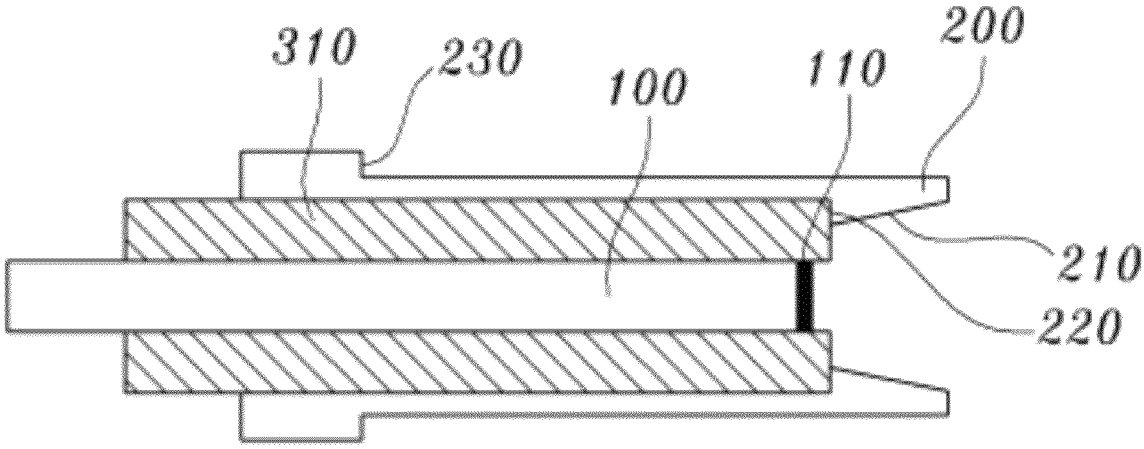
FIG. 4 illustrates the portion A of FIG. 3 in enlargement.

FIG. 3 is a cross section of the super miniature X-ray tube using the nano material field emitter according to the second embodiment, and FIG. 4 illustrates A portion of FIG. 3 in enlargement.

Referring to FIGS. 3 and 4, the super miniature X-ray tube using nano material field emitter according to the second embodiment may include a tip-type cathode electrode 100, a first high voltage insulating portion 310, a gate electrode 200, a second high voltage insulating portion 320, an anode electrode 400, and an electric field adjusting electrode 500.

The tip-type cathode electrode 100 has the same structure and function as the tip-type cathode electrode of the super miniature X-ray tube using the nano material field emitter according to the first embodiment.

Accordingly, the tip-type cathode electrode 100 may be formed from a metal wire and include a plan surface formed on one end, so that a nano material field emitter 110 is adhered to the planar surface using drop coating method to generate electron beams.

The first high voltage insulating portion 310 may be formed in a hollow cylindrical shape, and surround the outer circumference of the cathode electrode 100.

Specifically, the cathode electrode 100 may be adhered to the inner circumference of the first high voltage insulating portion 310 by using metal adhesive, or the like, and the first high voltage insulating portion 310 may be formed from one of alumina ($Al_2O_2$), sapphire, Teflon®, Pyrex®, and glass.

The gate electrode 200 receives an electron beam generating voltage to generate an electron beam. Referring to FIGS. 3 and 4, the gate electrode 200 may include a tapered portion 210 formed in a hollow cylindrical shape and surrounding the outer circumference of the first high voltage insulating portion 310. The tapered portion 210 may be formed at an inclination ranging from about 5 to about 30 degrees with reference to the inner circumference of the gate electrode 200.

Referring to FIG. 4, the gate electrode 200 may include a first stepped portion 220 formed as a cylindrical hole on the inner circumference, and a second stepped portion 230 formed as a cylindrical hole on the outer circumference.

The first stepped portion 220 may firmly receive therein the first high voltage insulating portion 310, and the second stepped portion 230 may firmly receive therein one side of the second high voltage insulating portion 320.

Specifically, since different electric potentials are applied to the tip-type cathode electrode 100 and the gate electrode 200 to emit the electric field, the tip-type cathode electrode 100 and the gate electrode 200 are electrically insulated from each other by the first high voltage insulating portion 310, and also electrically insulated from the anode electrode 400 by the second high voltage insulating portion 320.

The second high voltage insulating portion 320 may be formed in a hollow cylindrical shape, and surround the outer circumference of the gate electrode 200. As the open portion on one side of the second high voltage insulating portion 320 is firmly inserted in the second stepped portion 230 of the gate electrode 200, the gate electrode 200 and the anode electrode 400 are kept at a distance and thus insulated from each other.

Like the first high voltage insulating portion 310, the second high voltage insulating portion 320 may be formed from one of alumina ($Al_2O^2$), sapphire, Teflon®, Pyrex® and glass.

One end of the second high voltage insulating portion 320 may be connected to the tip-type cathode electrode 100 having the nano material field emitter 110 coated thereon, the gate electrode 200, and the first high voltage insulating portion 310 to apply different electric potentials to the tip-type cathode electrode 100 and the gate electrode 200 to generate electron beam, and the other end thereof may be connected to the anode electrode 400.

Accordingly, according to the second embodiment, the super miniature X-ray tube using nano material field emitter may insulate the entire triode and generate and accelerate the electron beams.

The structure and function of the anode electrode 400 and the electric field adjusting electrode 500 of the super miniature X-ray tube using nano material field emitter according to the second embodiment are almost identical to those of the cathode electrode and the electric field adjusting electrode 500 according to the first embodiment.

Accordingly, referring to FIG. 3, the anode electrode 400 is at a predetermined distance from one end of the second high voltage insulating portion 320, receives acceleration voltage to accelerate the electron beams generated at the cathode electrode 100, and includes the open portion 410 on one side to receive therein the electric field adjusting electrode 500, and the X-ray generating portion 420 formed on the other side to generate an X-ray by the collision of the accelerated electron beams.

The electric field adjusting electrode 500 may be formed in a hollow cylindrical shape and positioned between the second high voltage insulating portion 320 and the anode electrode 400 to adjust the size of the electron beams by varying the pattern of the acceleration electric field. The electric field adjusting electrode 500 may also include a front inclining protrusion 51 or a rear inclining protrusion 520 formed on the inner circumference at an inclination from about 0 to about 40 degrees with respect to the inner circumference of the electric field adjusting electrode 500 depending on the convergence size of the electron beam.

Figure 8:
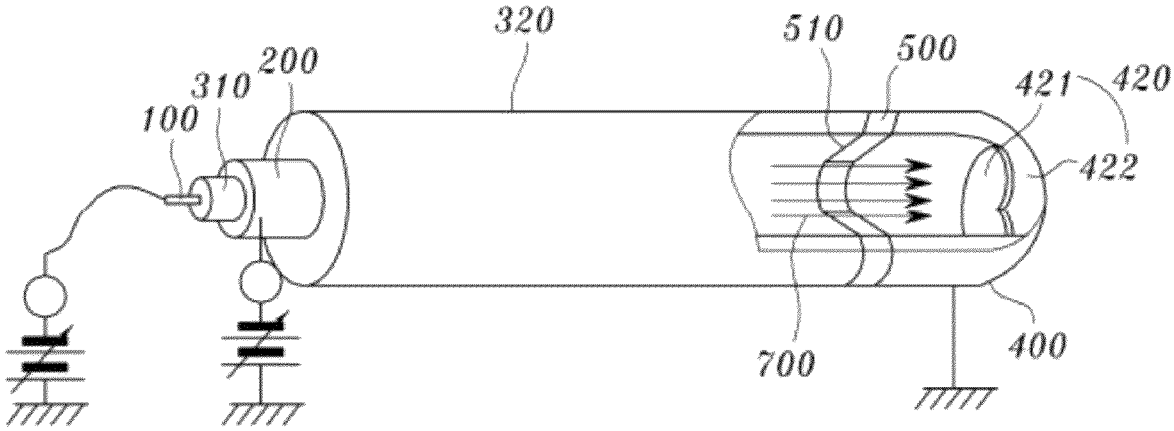
FIG. 8 illustrates a movement of electron beams by an electric field adjusting electrode of a super miniature X-ray tube using nano material field emitter according to the second embodiment.

FIG. 8 illustrates a movement of electron beams by an electric field adjusting electrode of a super miniature X-ray tube using nano material field emitter according to the second embodiment.

Referring to FIG. 8, electron beam is generated from the nano material field emitter 110 charged to from about 0 kV to about −50 kV and the gate electrode 200, accelerated by the grounded anode electrode 400, and then passes through the divergence-controlled electric field formed by the electric field adjusting electrode 500 having the front inclining protrusion 510, to enter into the X-ray target 421 in a parallel direction.

The size of the electron beam hitting the anode electrode 400 may vary by 30% maximum, depending on the inclining degrees of the front inclining protrusion 510 or the rear inclining protrusion 520 formed on the electric field adjusting electrode 500, and therefore, the front inclining protrusion 510 or the rear inclining protrusion 520 may be inclined at an angle of approximately 0 to 40 degrees in forward or backward direction with respect to the anode electrode 400 according to the size of a specific electron beam.

Meanwhile, referring to FIG. 3 and FIGS. 9A to 9C, the super miniature X-ray tube using nano material field emitter according to the second embodiment may additionally include a getter target 600.

The structure and function of the getter target 600 of the super miniature X-ray tube using nano material field emitter according to the second embodiment are identical to those of the getter target according to the first embodiment.

The getter target 600 may be formed from a gasifiable or non-gasifiable metal alloy and absorb remaining atmospheric gas in vacuum. By way of example, the getter target 600 may be made from barium (Ba), aluminum (Al), magnesium (Mg), zirconium (Zr), vanadium (V), cobalt (Co), titanium (Ti), palladium (Pd), or an alloy thereof.

Although certain examples of the super miniature X-ray tube using nano material field emitter have been explained above, the present inventive concept is not limited to the embodiments and drawings provided herein.

The foregoing exemplary embodiments and advantages are merely exemplary and are not to be construed as limiting the present inventive concept. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A super miniature X-ray tube using a nano material field emitter, comprising:

a tip-type cathode electrode comprising the nano material field emitter formed on one end with a planar section thereof to generate an electron beam;

a gate and focusing electrode formed in a hollow cylindrical shape and surrounding an outer circumference of the cathode electrode, the gate electrode comprising a tapered portion formed on one end and inclined from inside to outside, the gate electrode receiving a voltage for generating the electron beam;

a high voltage insulating portion formed in a hollow cylindrical shape and surrounding an outer circumference of the gate electrode;

an anode electrode formed at a predetermined distance from one end of the high voltage insulating portion and receiving an acceleration voltage to accelerate an electron beam generated at the cathode electrode; and an electric field adjusting electrode formed between the high voltage insulating portion and the anode electrode to vary a pattern of an acceleration electric field, wherein the anode electrode comprises an open portion formed on one side to receive therein the electric field adjusting electrode, and an X-ray generating portion formed on the other side to generate an X-ray by a collision of an accelerated electron beam.

2. A super miniature X-ray tube using a nano material field emitter, comprising:

a tip-type cathode electrode comprising the nano material field emitter formed on one end with a planar section thereof to generate an electron beam;

a first high voltage insulating portion formed in a hollow cylindrical shape and surrounding an outer circumference of the cathode electrode;

a gate electrode formed in a hollow cylindrical shape and surrounding an outer circumference of the first high voltage insulating portion, the gate electrode comprising a tapered portion formed on one end and inclining from inside to outside, the gate electrode receiving a voltage for generating the electron beam;

a second high voltage insulating portion formed in a hollow cylindrical shape and surrounding an outer circumference of the gate electrode;

an anode electrode formed at a predetermined distance from one end of the second high voltage insulating portion and receiving an acceleration voltage for accelerating an electron beam generated at the cathode electrode; and an electric field adjusting electrode formed between the second high voltage insulating portion and the anode electrode to adjust a size of the electron beam by varying a pattern of the accelerated electric field, wherein the anode electrode comprises an open portion formed on one side to receive therein the electric field adjusting electrode, and an X-ray generating portion formed on the other side to generate an X-ray by a collision of the accelerated electron beam.

3. The super miniature X-ray tube using the nano material field emitter of claim 1, further comprising a getter target formed on an inner side of the open portion of the anode electrode, or additionally on outer side of gate and cathode electrodes to maintain an interior of the X-ray tube in a vacuum state.

4. The super miniature X-ray tube using the nano material field emitter of claim 1, wherein the X-ray generating portion comprises:

an X-ray target which generates an X-ray by a collision of an accelerated electron beam; and an X-ray permeable window which covers an outer surface of the X-ray target, the X-ray permeable window on which the X-ray target is deposited and which emits the X-ray to outside.

5. The super miniature X-ray tube using the nano material field emitter of claim 4, wherein the X-ray target is formed from at least one of: molybdenum (Mo), tantalum (Ta), tungsten (W), copper (Cu), and gold (Au).

6. The super miniature X-ray tube using the nano material field emitter of claim 4, wherein the X-ray permeable window is formed from at least one of: beryllium (Be), beryllium-copper (BeCu), Beryllium-Aluminum (BeAl), aluminum (Al), carbon (C), and copper (Cu).

7. The super miniature X-ray tube using the nano material field emitter of claim 1, wherein the electric field adjusting electrode either converges or diverges the electron beam.

8. The super miniature X-ray tube using the nano material field emitter of claim 7, wherein the electric field adjusting electrode comprises:

a rear inclining protrusion formed on an inner circumference and inclining towards the cathode electrode; or a first inclining protrusion formed on an inner circumference and inclining towards the anode electrode.

9. The super miniature X-ray tube using the nano material field emitter of claim 8, wherein the front or rear inclining protrusion is formed at an angle approximately between 0 and 40 degrees with respect to an inner circumference of the electric field adjusting electrode.

10. The super miniature X-ray tube using the nano material field emitter of claim 1, wherein the tapered portion is at an angle approximately between 5 and 30 degrees with respect to an inner circumference of the gate electrode.

11. The super miniature X-ray tube using the nano material field emitter of claim 1, wherein the gate electrode comprises a first stepped portion formed on an inner circumference to which the cathode electrode is fixed; and a second stepped portion formed on an outer circumference to which the open portion formed on one side of the high voltage insulating portion is fixed.

12. The super miniature X-ray tube using the nano material field emitter of claim 2, wherein the gate electrode comprises a first stepped portion formed on an inner circumference to which the first high voltage insulating portion is fixed; and a second stepped portion formed on an outer circumference to which the open portion formed on one side of the second high voltage insulating portion is fixed.

13. The super miniature X-ray tube using the nano material field emitter of claim 11, wherein the high voltage insulating portion, the first high voltage insulating portion, and the second high voltage insulating portion are each formed from one of: alumina ($Al_2O_3$), sapphire, Teflon®, Pyrex®, and glass.

14. The super miniature X-ray tube using the nano material field emitter of claim 2, further comprising a getter target formed on an inner side of the open portion of the anode electrode, or additionally on outer side of gate and cathode electrodes to maintain an interior of the X-ray tube in a vacuum state.

15. The super miniature X-ray tube using the nano material field emitter of claim 2, wherein the X-ray generating portion comprises:

an X-ray target which generates an X-ray by a collision of an accelerated electron beam; and an X-ray permeable window which covers an outer surface of the X-ray target, the X-ray permeable window on which the X-ray target is deposited and which emits the X-ray to outside.

16. The super miniature X-ray tube using the nano material field emitter of claim 15, wherein the X-ray target is formed from at least one of: molybdenum (Mo), tantalum (Ta), tungsten (W), copper (Cu), and gold (Au).

17. The super miniature X-ray tube using the nano material field emitter of claim 15, wherein the X-ray permeable window is formed from at least one of: beryllium (Be), beryllium-copper (BeCu), Beryllium-Aluminum (BeAl), aluminum (Al), carbon (C), and copper (Cu).

18. The super miniature X-ray tube using the nano material field emitter of claim 2, wherein the electric field adjusting electrode either converges or diverges the electron beam.

19. The super miniature X-ray tube using the nano material field emitter of claim 18, wherein the electric field adjusting electrode comprises:

a rear inclining protrusion formed on an inner circumference and inclining towards the cathode electrode; or a first inclining protrusion formed on an inner circumference and inclining towards the anode electrode.

20. The super miniature X-ray tube using the nano material field emitter of claim 19, wherein the front or rear inclining protrusion is formed at an angle approximately between 0 and 40 degrees with respect to an inner circumference of the electric field adjusting electrode.

21. The super miniature X-ray tube using the nano material field emitter of claim 2, wherein the tapered portion is at an angle approximately between 5 and 30 degrees with respect to an inner circumference of the gate electrode.

22. The super miniature X-ray tube using the nano material field emitter of claim 12, wherein the high voltage insulating portion, the first high voltage insulating portion, and the second high voltage insulating portion are each formed from one of: alumina ($Al_2O_3$), sapphire, Teflon®, Pyrex®, and glass.

* * * * *